US009725138B2

(12) United States Patent
Baylot et al.

(10) Patent No.: US 9,725,138 B2
(45) Date of Patent: Aug. 8, 2017

(54) OFFSET INSTALLATION SYSTEMS

(71) Applicant: SHELL OIL COMPANY, Houston, TX (US)

(72) Inventors: Michel Pierre Baylot, Marghera (IT); Raymond Albert Louis Hallot, St. Quentin en Yvelines (FR); Yann Hajeri, Marghera (IT); Stephane Franck Gueydane, Marghera (IT); Matteo Scarpa, Marghera (IT)

(73) Assignee: SHELL OIL COMPANY, Houston, TX (US)

( * ) Notice: Subject to any disclaimer, the term of this patent is extended or adjusted under 35 U.S.C. 154(b) by 0 days.

(21) Appl. No.: 14/912,528

(22) PCT Filed: Aug. 19, 2014

(86) PCT No.: PCT/US2014/051622

§ 371 (c)(1),
(2) Date: Feb. 17, 2016

(87) PCT Pub. No.: WO2015/026778

PCT Pub. Date: Feb. 26, 2015

(65) Prior Publication Data

US 2016/0207593 A1 Jul. 21, 2016

Related U.S. Application Data

(60) Provisional application No. 61/867,483, filed on Aug. 19, 2013.

(51) Int. Cl.

| | |
|---|---|
| ***B63B 22/18*** | (2006.01) |
| ***B63B 22/02*** | (2006.01) |
| ***B63B 22/04*** | (2006.01) |
| ***B63B 22/20*** | (2006.01) |
| ***E21B 19/00*** | (2006.01) |
| ***E21B 41/00*** | (2006.01) |
| *B63B 21/00* | (2006.01) |

(52) U.S. Cl.

CPC ..... *B63B 22/18* (2013.01); *B63B 22/02* (2013.01); *B63B 22/04* (2013.01); *B63B 22/20* (2013.01); *E21B 19/002* (2013.01); *E21B 41/00* (2013.01); *B63B 2021/007* (2013.01); *B63B 2022/028* (2013.01)

(58) Field of Classification Search

CPC ..... B63B 22/00; B63B 22/02; B63B 22/04; B63B 22/18; B63B 22/20; B63B 22/021; B63B 2022/028

USPC ..... 441/3, 21, 26

See application file for complete search history.

(56) References Cited

U.S. PATENT DOCUMENTS

| | | | | |
|---|---|---|---|---|
| 3,906,564 | A | 9/1975 | Thompson et al. | |
| 4,037,278 | A * | 7/1977 | Dotti | B63B 35/4406 441/21 |
| 4,839,873 | A | 6/1989 | Cochrane, Jr. et al. | |
| 5,095,841 | A | 3/1992 | Santos et al. | |

(Continued)

FOREIGN PATENT DOCUMENTS

| | | |
|---|---|---|
| EP | 2474467 | 7/2012 |
| WO | 2013039048 | 3/2013 |

*Primary Examiner* — Lars A Olson

(57) ABSTRACT

A subsea buoy comprising: a frame comprising one or more winches and a subsea equipment attachment point and one or more buoyancy modules attached to the frame and associated systems and methods.

16 Claims, 2 Drawing Sheets

(56) References Cited

U.S. PATENT DOCUMENTS

| | | | |
|---|---|---|---|
| 5,190,107 | A | 3/1993 | Langner et al. |
| 7,086,807 | B2 | 8/2006 | Mackinnon |

* cited by examiner

OFFSET INSTALLATION SYSTEMS

CROSS REFERENCE TO RELATED APPLICATIONS

The present application is a National Stage (§371) of International Application No. PCT/US2014/051622, filed Aug. 19, 2014, which claims priority from U.S. Provisional Application No. 61/867,483, filed Aug. 19, 2013, the disclosures of each of which are hereby incorporated by reference in their entirety.

BACKGROUND

The present disclosure relates generally to offset installation systems. More specifically, in certain embodiments, the present disclosure relates to offset installation systems capable of transporting equipment to a seabed without direct overhead surface equipment and associated methods.

During the lifetime of a subsea well, it may be desirable to transport subsea equipment from the surface to the sea floor. This is often accomplished using a vessel to directly lower a payload to the sea floor. In such a system, a subsea payload would typically be suspended by a cable that extends vertically from the vessel to the payload. At surface, the cable may be connected to a crane or winch on the vessel. The x-y position of the payload may be adjusted by moving the x-y position of the vessel or the crane. The z position of the payload may be controlled by raising or lowering the cable with the crane or winch. This operation may be augmented by heave compensation devices which reduce the effect of wave activity at the surface.

It may be desirable to place equipment on, or nearby, a wellbore which has experienced an uncontrolled release of hydrocarbons into the environment. Typically, the equipment would be deployed from the surface vessel vertically above the wellhead. However, this is not always possible due to the presence of flammable gas and/or volatile organic compounds rising from the well at that location. Thus, conventional methods of transporting subsea equipment to a seafloor near a wellbore experiencing an uncontrolled release of hydrocarbons may be insufficient.

It is desirable to develop a method of transporting subsea equipment to a seabed location without requiring the use of surface equipment directly above the seabed location.

SUMMARY

The present disclosure relates generally to offset installation systems. More specifically, in certain embodiments, the present disclosure relates to offset installation systems capable of transporting equipment to a seabed without direct overhead surface equipment and associated methods.

In one embodiment, the present disclosure provides a subsea buoy comprising: a frame comprising one or more winches and a subsea equipment attachment point and one or more buoyancy modules attached to the frame.

In another embodiments, the present disclosure provides an offset installation system comprising: a subsea buoy, wherein the subsea buoy comprises: a frame comprising one or more winches and a subsea equipment attachment point and one or more buoyancy modules attached to the frame and one or more anchors, wherein the one or more anchors are connected to the one or more winches by one or more mooring lines.

In another embodiment, the present disclosure provides a method comprising: providing a subsea buoy, wherein the subsea buoy comprises a frame comprising one or more winches and a subsea equipment attachment point and one or more buoyancy modules attached to the frame; connecting subsea equipment to the subsea equipment attachment point; and transporting the subsea equipment to a location near the sea floor.

BRIEF DESCRIPTION OF THE DRAWINGS

A more complete and thorough understanding of the present embodiments and advantages thereof may be acquired by referring to the following description taken in conjunction with the accompanying drawings.

The features and advantages of the present disclosure will be readily apparent to those skilled in the art. While numerous changes may be made by those skilled in the art, such changes are within the spirit of the disclosure.

DETAILED DESCRIPTION

The description that follows includes exemplary apparatuses, methods, techniques, and/or instruction sequences that embody techniques of the inventive subject matter. However, it is understood that the described embodiments may be practiced without these specific details.

The present disclosure relates generally to offset installation systems. More specifically, in certain embodiments, the present disclosure relates to offset installation systems capable of transporting equipment to a seabed without direct overhead surface equipment and associated methods.

Some desirable attributes of the methods discussed herein are that they may permit the deployment of equipment to a seabed location without requiring that a surface vessel be present directly above the seabed location. In certain embodiments, the methods discussed herein may be useful transporting subsea equipment near or onto a well experiencing an uncontrolled release of hydrocarbons.

Figure 1:
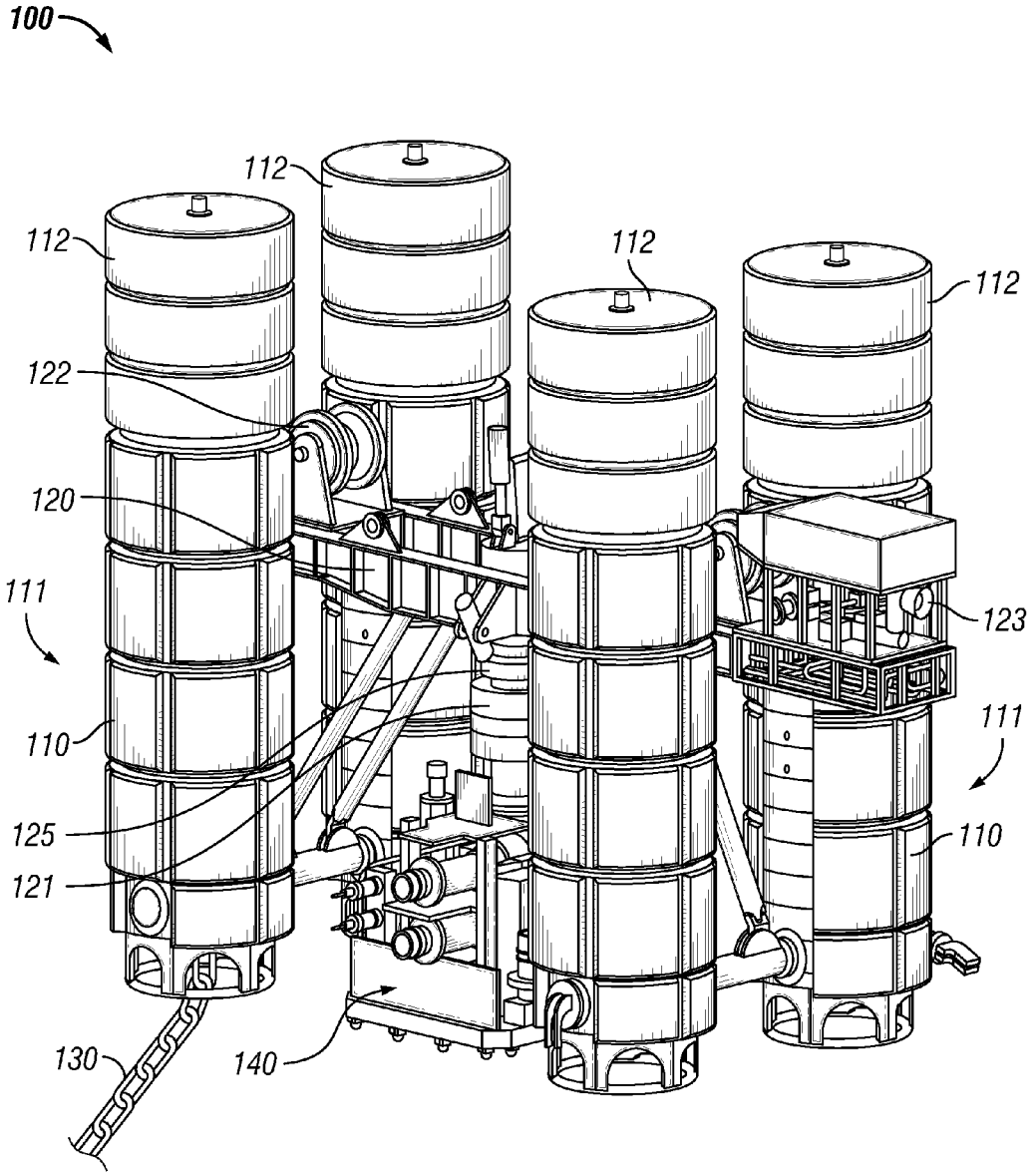
FIG. 1 illustrates a subsea buoy in accordance with certain embodiments on the present disclosure.

Referring now to FIG. 1, FIG. 1 illustrates a subsea buoy 100 in accordance with certain embodiments of the present disclosure. As can be seen in FIG. 1, subsea buoy 100 may comprise one or more buoyancy modules 110 and frame 120. In certain embodiments, the one or more buoyancy modules 110 may be connected to the frame 120 by any conventional means. Examples of conventional means include bolts and fasteners. In certain embodiments, each component of subsea buoy 100 may be of modular construction. In certain embodiments, each component of subsea buoy 100, or subsea buoy 100 itself, may be capable of being transported by air freight.

In certain embodiments, the one or more buoyancy modules 110 may be cylindrically shaped and be specifically sized to support a payload for a specific application. In certain embodiments, the one or more buoyancy modules 110 may comprise an air tank 111 and one or more buoyancy elements 112. In certain embodiments, air tank 111 may enable the net buoyancy of the subsea buoy 100 to be adjusted subsea. In certain embodiments, one or more buoyancy elements 112 may be added around or on top of air tank 111 to achieve a fixed buoyancy value.

In certain embodiments, the frame 120 may be an internal structure or an external structure. In certain embodiments, frame 120 may be constructed of steel. In certain embodiments, frame 120 may comprise a subsea equipment attachment point 121, one or more winches 122, and a docking point 123.

In certain embodiments, subsea equipment attachment point 121 may comprise a well head connector or any other suitable payload interface such as rigging, rings, or quick connectors. In certain embodiments, subsea equipment attachment point 121 may permit the attachment of subsea equipment 140 to the subsea buoy 100. In certain embodiments, subsea buoy 100 may comprise subsea equipment 140 attached to the subsea equipment attaching point 121. Subsea equipment 140 may be any type of subsea equipment. In certain embodiments, subsea equipment 140 may comprise capping stacks, manifolds, templates, processing equipment, and pipelines. In certain embodiments, the subsea equipment attachment point 121 may be connected to frame 120 by a cardan joint 125. In certain embodiments, cardan joint 125 may provide one or more degrees of freedom to manipulate the position and orientation of subsea equipment attachment point 121 relative to frame 100. In certain embodiments, subsea equipment attachment point 121 may be remotely set to a desired vertical angle. In certain embodiments, subsea equipment attachment point 121 may comprise a stroking mechanism for installation of the subsea equipment.

In certain embodiments, one or more winches 122 may be connected to frame 120 by any conventional means. Examples of conventional means include welding or fastening with fasteners. In certain embodiments, the winches may facilitate a connection to one or more mooring lines (not illustrated in FIG. 1). In certain embodiments, the one or more winches 122 may be remotely controlled and instrumented for pay-out and tension detection. In certain embodiments, an integral control system may control the winches. In certain embodiments, the integral control system may be remotely operated. In certain embodiments, the integral control system may be operated via an umbilical line (not illustrated in FIG. 1) providing power and communication to subsea buoy 100 via docking point 123. In certain embodiments, the integral control system may be operated via an ROV (not illustrated in FIG. 1) attached to docking point 123. In certain embodiments, one or more winches 122 may be controlled and instrumented that enable position control both in respects of vertical and horizontal movement and hold subsea buoy 100 sufficiently stationary within a plume arising from a well head.

In certain embodiments, the docking point 123 may comprise a docking point capable of providing electrical power and communication interface with a surface vessel through an ROV. In certain embodiments, the docking point 123 may comprise a docking point capable of providing electrical power and communication interface with a surface vessel via an umbilical line.

In certain embodiments, subsea buoy 100 may further comprise a drag chain 130. In certain embodiments, drag chain 130 may be attached to frame 120 by any conventional means, such as welding or fastening.

Figure 2:
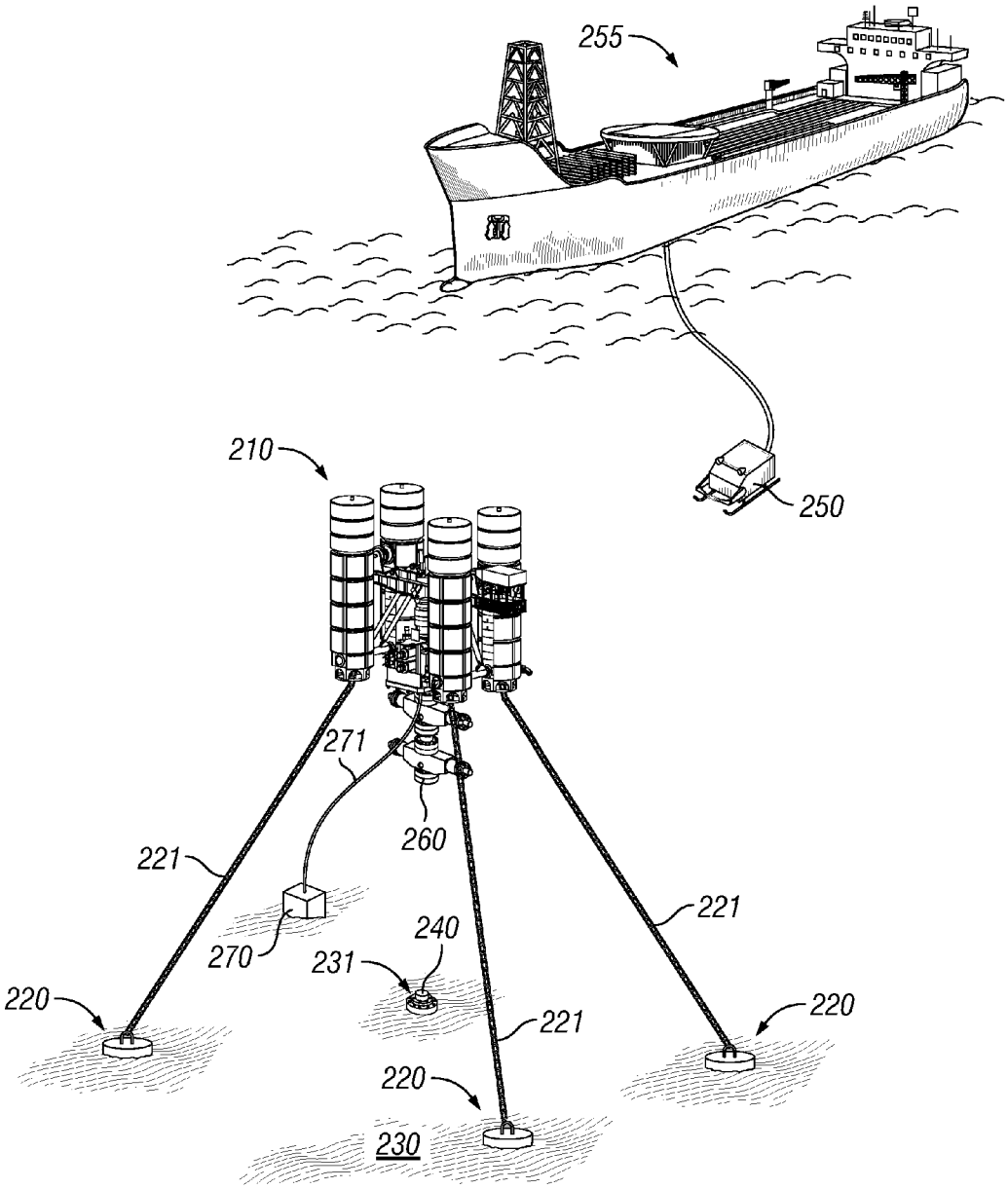
FIG. 2 illustrates an offset installation system in accordance with certain embodiments of the present disclosure.

Referring now to FIG. 2, FIG. 2 illustrates an offset installation system 200 comprising subsea buoy 210 and one or more anchors 220. In certain embodiments, subsea buoy 210 may comprise any combination of features discussed above with respect to subsea buoy 100.

As can be seen in FIG. 2, subsea buoy 210 may be connected to three anchors 220 by three mooring lines 221. In certain embodiments, not illustrated, mooring lines 221 may be connected to one or more winches disposed on subsea buoy 210. In certain embodiments, the one or more anchors 220 may be anchored to the seafloor 230. In certain embodiments, the one or more anchors 220 may be anchored around a subsea location 231 at a distance of from about 10 meters to about 100 meters from subsea location 231. In certain embodiments, the one or more anchors 220 may be anchored around a subsea location 231 at a distance of from about 20 meters to about 50 meters from subsea location 231. In certain embodiments, the one or more anchors 220 may be anchored around a subsea location 231 at a distance of from about 20 meters to about 30 meters from subsea location 231. In certain embodiments, the one or more anchors 220 may be an equal distance from subsea location 231 and spaced equally about subsea location 231. In other embodiments, the one or more anchors 220 may not be an equal distance from subsea location 231 and not spaced equally about subsea location 230.

In certain embodiments, when subsea buoy 210 is connected to the one or more anchors 220, the subsea buoy may be positioned at a maximum distance away from the subsea location 231. For example, when subsea buoy 210 is connected to the one or more anchors 220 spaced 40 meters away from subsea location 230, the subsea buoy 210 may be positioned at a maximum distance away from the subsea location 230 of 25 meters.

In certain embodiments (not illustrated in FIG. 2), the one or more anchors may each be attached to a subsea structure instead of seafloor 230. In certain embodiments, the subsea structure may comprise a well head, a blowout preventer, or any other subsea structure. In certain embodiments, the subsea structure may be experiencing an uncontrolled release of hydrocarbons.

In certain embodiments, a subsea structure 240 may be disposed on sea floor 230 at subsea location 231. In certain embodiments, subsea structure 240 may comprise a well head, a blowout preventer, or any other subsea structure. In certain embodiments, subsea structure 240 may be experiencing an uncontrolled release of hydrocarbons.

In certain embodiments, offset installation system 200 may further comprise an ROV 250. In certain embodiments, ROV 250 may be capable of docking with a docking point of subsea buoy 210 and capable of providing electrical power and communication interface with a surface vessel 255.

In certain embodiments, offset installation system may further comprise subsea equipment 260. In certain embodiments, subsea equipment 260 may be attached to subsea buoy 210.

In certain embodiments, offset installation system may further comprise an existing subsea structure 270. In certain embodiments, existing subsea structure 270 may comprise a blowout preventer, a guide base, or a subsea anchor. In certain embodiments, one or more pennant lines 271 may attach subsea buoy 210 to existing subsea structure 270.

In certain embodiments, the present disclosure provides a method comprising: providing a subsea buoy, wherein the subsea buoy comprises a frame comprising one or more winches and a subsea equipment attachment point and one or more buoyancy modules attached to the frame; connecting subsea equipment to the subsea equipment attachment point; and transporting the subsea equipment to a location near the sea floor.

In certain embodiments, providing a subsea buoy may comprise towing a subsea buoy into a position at a controlled depth, close to the location near the sea floor. In certain embodiments, the buoy may be towed into the position by any conventional vessel. Examples of conventional vessels include drill vessels, drill ships, supply ships, and anchor handlers. In certain embodiments, the buoy may be towed at a controlled depth of from 1 to 100 meters above the sea floor. In certain embodiments the buoy may be towed at a controlled depth of from 10 to 50 meters above the sea floor. In certain embodiments, the buoy may be towed at a controlled depth of from 15 to 30 meters above the sea floor. In certain embodiments, the depth may be controlled by a combination of the buoyancy modules and the drag chain. In certain embodiments, the buoy may be towed into a position that is within 0 to 100 meters of the location. In certain embodiments, the buoy may be towed into a position that is within 5 to 50 meters of the location.

In other embodiments, providing a subsea buoy may comprise lowering a subsea buoy from a vessel to a controlled depth close to the location near the sea floor. In certain embodiments, the subsea buoy may be lowered to a controlled depth of from 10 to 50 meters above the sea floor at a distance of 0 to 100 meters from the location. In certain embodiments, the subsea buoy may be lowered to a controlled depth of from 15 to 30 meters above the sea floor and a distance of 5 to 50 meters from the location.

In other embodiments, providing a subsea buoy may comprise locating a subsea buoy. In certain embodiments, the subsea buoy may be located at a controlled depth of from 10 to 50 meters above the sea floor at a distance of 0 to 100 meters from the location. In certain embodiments, the subsea buoy may be located at a controlled depth of from 15 to 30 meters above the sea floor and a distance of 5 to 50 meters from the location.

In certain embodiments, providing a subsea buoy may further comprise attaching the subsea buoy to one or more mooring lines. In certain embodiments, the one or more mooring lines may be attached to one or more anchors on the sea floor surrounding a subsea structure. In certain embodiments, the one or more mooring lines may be attached to the subsea structure. In certain embodiments, the subsea structure may comprise a well head, a blowout preventer, or any other subsea structure. In certain embodiments, the subsea structure may be experiencing an uncontrolled release of hydrocarbons.

In certain embodiments, connecting subsea equipment to the subsea buoy may comprise utilizing an ROV to attach the subsea equipment to the connection point via a quick connect device such as a wellhead connection or via standard rigging equipment. In certain embodiments, the subsea equipment may be connected to the buoy before or after the buoy is towed into the position. In certain embodiments, the subsea equipment may be connected to the buoy before or after the buoy is secured to the one or more mooring lines.

In certain embodiments, transporting the subsea equipment to the location near sea floor may comprise winching in the one or more mooring lines until the subsea buoy and subsea equipment is brought to the subsea structure. In certain embodiments, the drag chain may be disconnected from the subsea buoy before the subsea equipment is transported to the location near the sea floor.

In certain embodiments, the method may further comprise attaching the subsea equipment to a subsea structure at the location near the sea floor. In certain embodiments, attaching the subsea equipment to the subsea structure may comprise installing a capping stack on a well head. In certain embodiments, an ROV may facilitate with the attachment of the subsea equipment to the subsea structure. In certain embodiments, after the subsea equipment is attached to the subsea structure, the subsea equipment may be unaattached from the subsea buoy.

In certain embodiments, the method may further comprise moving the subsea buoy away from the seafloor. In certain embodiments, the subsea buoy may be moved away from the seafloor after the subsea equipment has been attached to the subsea structure. In certain embodiments, the subsea buoy may be moved away from the seafloor by paying out the winches.

While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

The invention claimed is:

1. A subsea buoy comprising:

a frame comprising one or more winches and a subsea equipment attachment point;

a capping stack attached to the subsea equipment attachment point; and one or more buoyancy modules attached to the frame.

2. The subsea buoy of claim 1, wherein the frame comprises a docking point.

3. The subsea buoy of claim 1, wherein the subsea equipment attachment point comprises a cardan joint.

4. The subsea buoy of claim 1, wherein the one or more buoyancy modules each comprises an air tank and one or more buoyancy elements.

5. The subsea buoy of claim 1, further comprising a drag chain attached to the frame.

6. The subsea buoy of claim 1, further comprising an integral control system capable of controlling the one or more winches.

7. The subsea buoy of claim 2, further comprising an ROV attached to the docking point.

8. An offset installation system comprising:

a subsea buoy, wherein the subsea buoy comprises:

a frame comprising one or more winches and a subsea equipment attachment point and one or more buoyancy modules attached to the frame and one or more anchors, wherein the one or more anchors are connected to the one or more winches by one or more mooring lines and wherein the one or more anchors are anchored to a sea floor surrounding a well head.

9. The offset installation system of claim 8, wherein the one or more anchors are anchored to a subsea structure.

10. The offset installation system of claim 8, wherein the well head is experiencing an uncontrolled release of hydrocarbons.

11. A method comprising:

providing a subsea buoy, wherein the subsea buoy comprises:

a frame comprising one or more winches and a subsea equipment attachment point and one or more buoyancy modules attached to the frame;

connecting a capping stack to the subsea equipment attachment point; and transporting the capping stack to a location near the sea floor.

12. The method of claim 11, wherein providing the subsea buoy comprises towing the subsea buoy into a position near the location at a controlled depth.

13. The method of claim 11, wherein providing the subsea buoy comprises attaching the subsea buoy to one or more mooring lines.

14. The method of claim 13, wherein the one or more mooring lines are attached to a structure on the sea floor.

15. The method of claim 13, wherein the one or more mooing lines are anchored to the sea floor around a structure on the sea floor.

16. The method of any one of claim 13, wherein transporting the capping stack to a location near the sea floor comprises winching in the one or more mooring lines until the subsea buoy and the capping stack are equipment is brought to the structure on the sea floor.

* * * * *